US010959034B2

(12) United States Patent
Brown et al.

(10) Patent No.: US 10,959,034 B2
(45) Date of Patent: Mar. 23, 2021

(54) REDUCING UNWANTED SOUND TRANSMISSION

(71) Applicant: Dolby Laboratories Licensing Corporation, San Francisco, CA (US)

(72) Inventors: C. Phillip Brown, Castro Valley, CA (US); Michael J. Smithers, Kareela (AU); Remi S. Audfray, San Francisco, CA (US); Patrick David Saunders, Castro Valley, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 16/961,087

(22) PCT Filed: Jan. 8, 2019

(86) PCT No.: PCT/US2019/012792

§ 371 (c)(1),
(2) Date: Jul. 9, 2020

(87) PCT Pub. No.: WO2019/139925

PCT Pub. Date: Jul. 18, 2019

(65) Prior Publication Data

US 2020/0359154 A1 Nov. 12, 2020

Related U.S. Application Data

(60) Provisional application No. 62/615,172, filed on Jan. 9, 2018.

(30) Foreign Application Priority Data

Jan. 9, 2018 (EP) ..... 18150772

(51) Int. Cl.
*H04S 7/00* (2006.01)
*H04R 29/00* (2006.01)

(52) U.S. Cl.
CPC ..... *H04S 7/301* (2013.01); *H04R 29/001* (2013.01); *H04S 2400/13* (2013.01)

(58) Field of Classification Search
CPC ..... H04N 11/00; G01H 3/14; H04R 29/00; H04R 29/001; H04R 3/005; H04R 27/00;
(Continued)

(56) References Cited

U.S. PATENT DOCUMENTS 4,783,818 A * 11/1988 Graupe ..... H03G 3/32 381/71.14
8,019,095 B2 9/2011 Seefeldt
(Continued)

FOREIGN PATENT DOCUMENTS

EP 0414524 2/1991
EP 3179744 6/2017
(Continued)

OTHER PUBLICATIONS

Moore, B. et al "A Model for the Prediction of Thresholds, Loudness, and Partial Loudness" JAES vol. 45, Issue 4, pp. 224-240, Apr. 1, 1997.

*Primary Examiner* — Ahmad F. Matar
*Assistant Examiner* — Sabrina Diaz

(57) ABSTRACT

A system and method of adjusting an audio output in one location so that its propagation into another location is reduced. As a first device in a first location generates sound, a second device in a second location detects the propagated sound. The first device then adjusts its output based on the detected sound.

22 Claims, 6 Drawing Sheets

200

(58) Field of Classification Search
CPC ..... H04R 1/1083; H04R 2410/07; H04S 7/40; H04S 7/301; H04S 2400/13; H03G 3/001; H03G 3/002; H03G 3/00; H03G 3/32; H03G 3/24; H03G 3/3005; H03G 3/3089; H03G 3/3026; H03G 9/005; H03G 9/025; H03G 1/0088; H03G 1/02; H03G 7/007; G10K 11/1788; G10K 11/178; G10K 11/1784; G10K 11/1782; G10K 2210/1081; G10K 2210/1282; G10K 2210/3032; G10K 2210/3045; G10L 21/0208; G10L 2021/02165; H04H 60/04; G11B 20/24
USPC ..... 381/107, 108, 104, 94.1, 56, 57, 71.1, 381/71.14
See application file for complete search history.

(56) References Cited

U.S. PATENT DOCUMENTS

2005/0063552 A1* 3/2005 Shuttleworth ..... H04R 29/00 381/57
2008/0273723 A1* 11/2008 Hartung ..... H04S 7/30 381/302
2009/0129604 A1 5/2009 Enamito
2012/0121097 A1 5/2012 Dreifus
2012/0195447 A1 8/2012 Hiruma
2016/0196818 A1* 7/2016 Christoph ..... H04K 3/825 381/71.6
2016/0211817 A1 7/2016 Krishnaswamy
2016/0366517 A1* 12/2016 Chandran ..... H04S 7/301
2016/0379618 A1* 12/2016 Torres ..... G10K 11/178 381/71.4
2017/0053641 A1* 2/2017 Kamdar ..... H04S 3/002
2017/0164110 A1* 6/2017 Hansson ..... H04R 3/005
2017/0195815 A1 7/2017 Christoph
2017/0245079 A1* 8/2017 Sheen ..... H04R 9/046
2018/0039474 A1* 2/2018 Shih ..... H04S 7/301

FOREIGN PATENT DOCUMENTS

ES 2087020 7/1996
JP 03278707 12/1991

* cited by examiner

100

Output:
Band 1 – 100 dB
Band 2 – 100 dB
Band 3 – 100 dB

FIG. 6A

Detected:
Band 1 – 75 dB
Band 2 – 60 dB
Band 3 – 50 dB

FIG. 6B

Thresholds:
Band 1 – 70 dB
Band 2 – 60 dB
Band 3 – 55 dB

FIG. 6C

Output (new):
Band 1 – 95 dB
Band 2 – 100 dB
Band 3 – 100 dB

FIG. 6D

Detected (new):
Band 1 – 70 dB
Band 2 – 60 dB
Band 3 – 50 dB

FIG. 6E

REDUCING UNWANTED SOUND TRANSMISSION

CROSS REFERENCE TO RELATED APPLICATIONS

This application claims priority of the following priority applications: U.S. provisional application No. 62/615,172, filed 9 Jan. 2018 and EP application no. 18150772.4, filed 9 Jan. 2018, which are hereby incorporated by reference.

BACKGROUND

The present disclosure relates to reducing audio transmission between adjacent rooms using intercommunication between devices.

Unless otherwise indicated herein, the approaches described in this section are not prior art to the claims in this application and are not admitted to be prior art by inclusion in this section.

A typical home includes a number of rooms such as a living room, a dining room and one or more bedrooms. On occasion, the audio generated by an audio device in one room may be perceived in another room. This can be distracting if a person is attempting to sleep in the other room, or is listening to audio at a level that is obscured by the audio from the adjacent room.

SUMMARY

In view of the above, there is a need to reduce the audio perceived in an adjacent room. An embodiment is directed to communication between two audio devices in the separate rooms. The audio transmission characteristics from one room to another are determined by playing audio through one device and detecting the transmitted audio by the other device. The transmission characteristics may be determined on a frequency band-by-band basis. This allows for frequency band-by-band adjustment during audio playback to reduce transmission from one room to another.

The audio devices may determine an audio transfer function for adjusting at least some frequency bands of the audio output to at least reduce transmission from one listening area to the other based on a comparison of the audio output to the detected audio.

A further feature may include dividing the audio output and the detected audio into spectral bands, performing a per band comparison of the detected audio with a band specific threshold level, and reducing only those bands of the audio output for which the detected audio exceeds the band specific threshold level (e.g., set at the audible level of human hearing in each particular band). Another further feature may include, when outputting audio in one room, detecting ambient sound in another room and comparing it to the known audio output, to determine whether audio is transferring from one listening area to another. Another further feature may include adapting the audio output based upon dialogue characteristics to enhance intelligibility of the audio output.

According to an embodiment, a method reduces the audibility of sound generated by an audio device. The method includes generating, by the audio device in a first location, an audio output. The method further includes detecting, in a second location that differs from the first location, a detected audio signal corresponding to the audio output. The method further includes communicating information related to the detected audio signal to the audio device, e.g. communicating said information from the second location to the audio device. The method further includes determining, by the audio device, an audio transfer function for attenuating one or more frequency bands based on the information. The method further includes modifying, by the audio device, the audio output by applying the audio transfer function. In this manner, the audibility of the audio output from the audio device may be reduced in the second location.

Determining the audio transfer function may include comparing the information related to the detected audio signal, information related to the audio output, and at least one threshold value.

A physical barrier may separate the first location and the second location, and the audio device may determine the audio transfer function of the detected audio signal according to the audio output as modified by the physical barrier.

The audio device may be a first audio device; a second audio device in the second location may detect the detected audio signal, and the second audio device may communicate the information related to the detected audio signal to the first audio device. The first audio device may modify the audio output contemporaneously with the second audio device detecting the detected audio signal. Alternatively, the second audio device may detect the detected audio signal during a setup phase; the first audio device may determine the audio transfer function during the setup phase; and the first audio device may modify the audio output during an operational phase that follows the setup phase.

The audio output may include a plurality of frequency bands, and modifying the audio output includes modifying, e.g. attenuating, the audio output in one or more of the plurality of frequency bands. The plurality of frequency bands may be defined according to a physiological response of human hearing. Modifying the audio output may include modifying the audio output in the one or more of the plurality of frequency bands by one or more different amounts based on a comparison of the audio output and the information related to the detected audio signal, optionally further taking into account a level of ambient noise of the second location.

The audio transfer function may be determined based on a measured transmission characteristic between the first location and the second location, taking into account a level of ambient noise of the second location. In an example, the ambient noise is determined by comparing the information related to the detected audio signal and the audio output. In another example, the ambient noise has been determined prior to the audio device generating an audio output, e.g. by detecting in the second location—in absence of any audio output by the audio device in the first location—an audio signal representative of ambient noise.

Optionally, the ambient noise is determined for each of the one or more frequency bands.

Optionally, the method comprises determining whether the ambient noise masks one or more frequency bands in the detected audio signal, wherein in response to determining that the ambient noise masks one or more frequency bands in the detected audio signal, the audio transfer function does not attenuate frequency bands of the audio output corresponding to said one or more masking frequency bands.

For example, it is determined for each of the frequency bands whether the level of the detected audio signal in that frequency band exceeds the ambient noise level of that frequency band, and only in response to determining that the detected audio signal exceeds the ambient noise level for said frequency band, is the audio output attenuated for said frequency band by the audio transfer function. No attenuation is applied to frequency bands for which the level of the detected audio signal does not exceed the ambient noise level, e.g. when the level of the detected audio signal is equal to or lower than the ambient noise level.

Optionally, a predetermined threshold is used in the comparison of the detected audio signal and the ambient noise level. For example, it is determined whether the detected audio signal exceeds the ambient noise level by at least the predetermined threshold. The predetermined threshold may be the same for all frequency bands, or a separate threshold may be provided for each frequency band.

The audio transfer function may be determined based on a measured transmission characteristic between the first location and the second location, and on a physiological response of human hearing.

The audio device includes a plurality of speakers, and modifying the audio output may include controlling loudspeaker directivity, using the plurality of speakers, to adjust a locational response of the audio output such that a level of the detected audio signal in the second location is reduced.

The audio output may be modified using at least one of loudness leveling and loudness domain processing.

The method may further include continuously detecting an ambient noise level in the second location using a microphone, and determining, using machine learning, at least one pattern in the ambient noise level having been detected, where the audio output is modified based on the audio transfer function and the at least one pattern. The microphone may be a microphone of the second audio device described above.

The method may further include generating, by a third audio device in a third location, a second audio output, where the detected audio signal detected in the second location corresponds to the audio output and the second audio output, where the information is related to the detected audio signal and the second detected audio signal, and where the information is communicated to the audio device and the third audio device. The method may further include determining, by the third audio device, a second audio transfer function for attenuating one or more frequency bands of the second audio output based on the information. The method may further include modifying, by the third audio device, the second audio output by applying the second audio transfer function.

According to an embodiment, an apparatus includes an audio device, a processor, a memory, a speaker, and a network component. The processor is configured to control the audio device to execute processing that includes generating, by the speaker in a first location, an audio output; receiving, by the network component from a second location that differs from the first location, information related to a detected audio signal corresponding to the audio output detected in the second location; determining, by the processor, an audio transfer function for attenuating one or more frequency bands of the audio output based on the information; and modifying, by the processor, the audio output based on the audio transfer function.

According to an embodiment, a system reduces the audibility of sound generated by an audio device. The system includes a first audio device and a second audio device. The first audio device includes a processor, a memory, a speaker, and a network component, and the second audio device includes a processor, a memory, a microphone, and a network component. The processor of the first audio device and the processor of the second audio device are configured to control the first audio device and the second audio device to execute processing that includes generating, by the speaker of the first audio device in a first location, an audio output; detecting, by the microphone of the second audio device in a second location that differs from the first location, a detected audio signal corresponding to the audio output; communicating, via the network component of the second audio device, information related to the detected audio signal from the second location to the network component of the first audio device; determining, by the processor of the first audio device, an audio transfer function for attenuating one or more frequency bands of the audio output based on the information; and modifying, by the processor of the first audio device, the audio output by applying the audio transfer function.

According to an embodiment, a non-transitory computer readable medium stores a computer program for controlling an audio device to reduce audibility of sound generated by the audio device. The device may include a processor, a memory, a speaker, and a network component. The computer program when executed by the processor may control the audio device to perform one or more of the method steps described above.

The following detailed description and accompanying drawings provide a further understanding of the nature and advantages of various implementations.

BRIEF DESCRIPTION OF THE DRAWINGS

FIGS. 6A-6E are tables that illustrate an example of the thresholds and frequency bands for the audio output and the detected audio signal.

DETAILED DESCRIPTION

Described herein are techniques for reducing audio transmission between adjacent rooms. In the following description, for purposes of explanation, numerous examples and specific details are set forth in order to provide a thorough understanding of the present disclosure. It will be evident, however, to one skilled in the art that the present disclosure as defined by the claims may include some or all of the features in these examples alone or in combination with other features described below, and may further include modifications and equivalents of the features and concepts described herein.

In the following description, various methods, processes and procedures are detailed. Although particular steps may be described in gerund form, such wording also indicates the state of being in that form. For example, "storing data in a memory" may indicate at least the following: that the data currently becomes stored in the memory (e.g., the memory did not previously store the data); that the data currently exists in the memory (e.g., the data was previously stored in the memory); etc. Such a situation will be specifically pointed out when not clear from the context. Although particular steps may be described in a certain order, such order is mainly for convenience and clarity. A particular step may be repeated more than once, may occur before or after other steps (even if those steps are otherwise described in another order), and may occur in parallel with other steps. A second step is required to follow a first step only when the first step must be completed before the second step is begun. Such a situation will be specifically pointed out when not clear from the context.

In this document, the terms "and", "or" and "and/or" are used. Such terms are to be read as having an inclusive meaning. For example, "A and B" may mean at least the following: "both A and B", "at least both A and B". As another example, "A or B" may mean at least the following: "at least A", "at least B", "both A and B", "at least both A and B". As another example, "A and/or B" may mean at least the following: "A and B", "A or B". When an exclusive-or is intended, such will be specifically noted (e.g., "either A or B", "at most one of A and B").

This document uses the terms "audio", "sound", "audio signal" and "audio data". In general, these terms are used interchangeably. When specificity is desired, the terms "audio" and "sound" are used to refer to the input captured by a microphone, or the output generated by a loudspeaker. The term "audio data" is used to refer to data that represents audio, e.g. as processed by an analog to digital converter (ADC), as stored in a memory, or as communicated via a data signal. The term "audio signal" is used to refer to audio that is detected, processed, received or transmitted in analog or digital electronic form.

Figure 1:
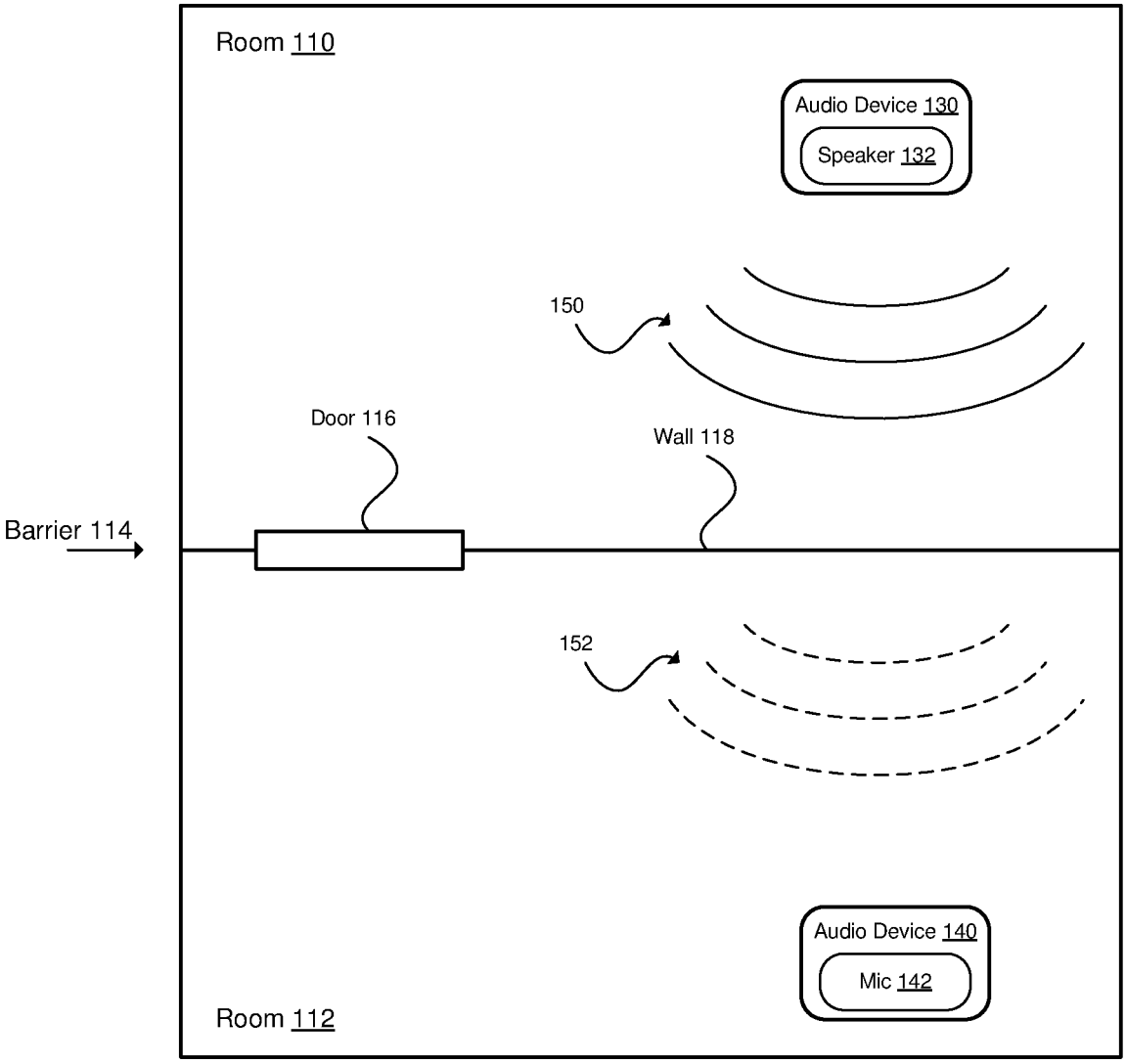
FIG. 1 is a diagram of an acoustic environment 100.

FIG. 1 is a diagram of an acoustic environment 100. Examples of the acoustic environment 100 include a house, an apartment, etc. The acoustic environment 100 includes a room 110 and a room 112. The acoustic environment 100 may include other rooms (not shown). The rooms 110 and 112 may be adjacent as shown, or may be separated by other rooms or spaces (e.g., a hallway). The rooms 110 and 112 may be on the same floor (as shown), or on different floors. The rooms 110 and 112 may also be referred to as locations.

The rooms 110 and 112 are separated by a physical barrier 114. The physical barrier 114 may include one or more portions, such as a door 116, a wall 118, a floor, a ceiling, etc.

An audio device 130 is located in the room 110, and an audio device 140 is located in the room 112. The audio device 130 includes a speaker 132, and may include other components. The audio device 140 includes a microphone 142, and may include other components. The audio devices 130 and 140 may be the same type of audio device (e.g., both having a speaker and a microphone). The speaker 132 generates an audio output 150, and the microphone 142 detects an audio signal 152 that corresponds to the audio output 150. For ease of description, the audio device 130 may be referred to as the active audio device (e.g., actively generating the audio output), and the audio device 140 may be referred to as the listening audio device (e.g., listening for the output from the active audio device); although each audio device may perform both functions at various times (e.g., a first device is generating an audio output and listening for the audio output from a second device, and the second device is generating an audio output and listening for the audio output from the first device).

In general, the audio device 130 modifies (e.g., reduces) its audio output in response to the audio detected by the audio device 140 (e.g., when the detected audio is above a threshold). More details regarding the operation of the audio devices 130 and 140 are described below with reference to FIG. 2.

Figure 2:
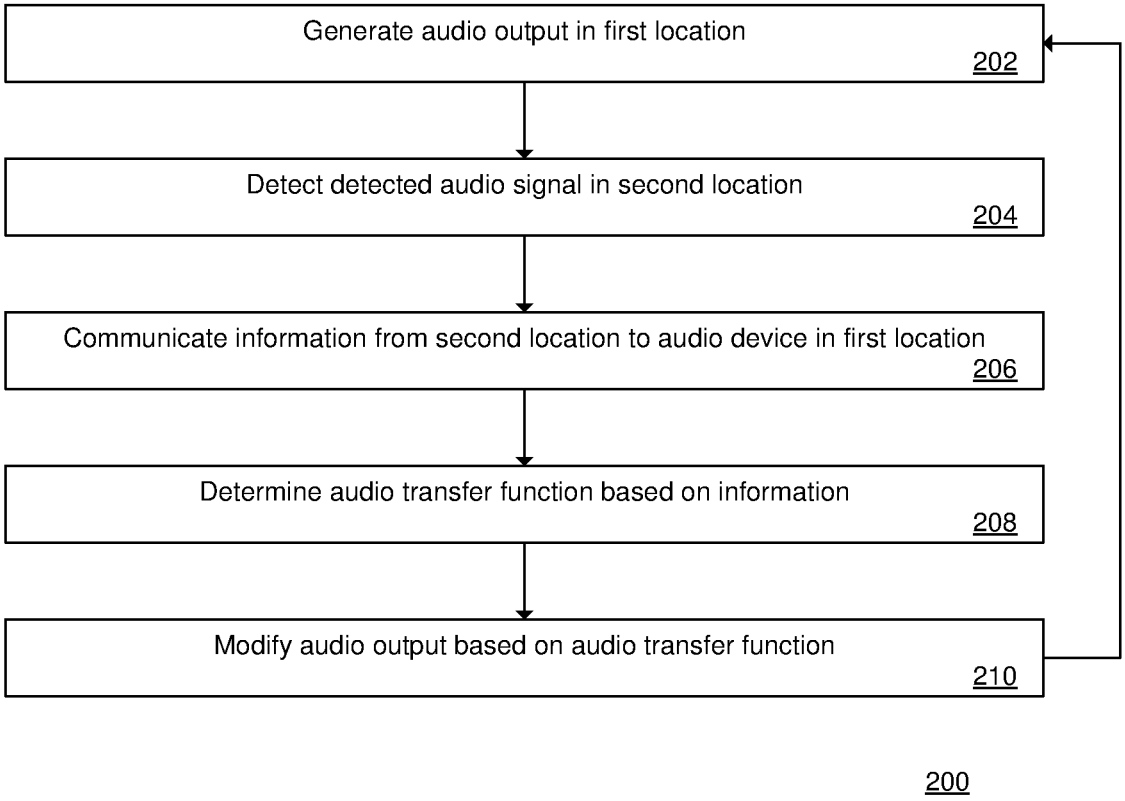
FIG. 2 is a flowchart of a method 200 of reducing the audibility of the sound generated by an audio device.

FIG. 2 is a flowchart of a method 200 of reducing the audibility of the sound generated by an audio device. For example, the method 200 may be performed by the audio device 130 and the audio device 140 (see FIG. 1) to reduce the audibility of sound that is generated in the room 110 and perceived in the room 112.

At 202, an audio device in a first location generates an audio output. For example, the audio device 130 (see FIG. 1) may generate the audio output 150 in the room 110.

At 204, an audio signal (referred to as the "detected audio signal") is detected in a second location. The detected audio signal corresponds to the audio output, as modified according to various factors such as distance, attenuation (e.g., due to physical barriers), and other sounds (e.g., ambient noise). For example, the audio device 140 (see FIG. 1) may detect the detected audio signal 152 in the room 112, where the detected audio signal 152 corresponds to the audio output 150 generated in the room 110, as modified according to the distance between the speaker 132 and the microphone 142, and the attenuation applied by the wall 118 and the door 116.

At 206, information related to the detected audio signal is communicated from the second location to the audio device (e.g., the audio device 130 of FIG. 1). For example, the audio device 140 (see FIG. 1) may transmit information related to the detected audio signal from the room 112 to the audio device 130 in the room 110.

At 208, the audio device (e.g., the audio device 130 of FIG. 1) determines an audio transfer function based on the information (communicated at 206). For example, the audio device 130 may determine an audio transfer function based on the information from the audio device 140. As an example, the audio device 130 may compare the audio output 150 and the information related to the detected audio signal 152 to determine the audio transfer function. In general, the audio transfer function is generated to attenuate the audio signal 150 as detected in the other room. The audio transfer function may correspond to different attenuations being applied to different frequency bands of the audio output 150. In general, if the detected audio signal 152 exceeds a defined threshold in a particular frequency band, the audio transfer function will attenuate that particular frequency band. For example, the attenuation may increase as the level of the detected audio exceeding the threshold increases.

The audio device may also take into account the ambient noise in the second location when determining the audio transfer function. For example, if there is a fan noise in the second room, the audio device in the first room may determine that the fan noise is present by comparing the information related to the detected audio signal (which includes the fan noise) and the audio output (which does not include the fan noise). In this manner, the audio device may determine the audio transfer function such that it excludes consideration of the fan noise, so that only the propagation of the audio output into the second location is considered, and the ambient sounds in the second location are excluded. Ambient noise may comprise any sound that does not correspond to the audio output attenuated by the transmission from the first location to the second location. In other words, ambient noise may comprise one or more components in the detected audio that cannot be attributed to the transmission of the audio output from the first location to the second location. For example, the ambient noise can be determined from a comparison between the audio detected at the second location and the audio output at the first location.

At 210, the audio device (e.g., the audio device 130 of FIG. 1) modifies the audio output based on the audio transfer function, i.e. by applying the audio transfer function. For example, if it was determined that the detected audio signal 152 is above a threshold in a particular frequency band, application of the audio transfer function by the audio device 130 may reduce the audio output 150, so that the detected audio signal 152 falls below the threshold (when subsequently detected). As an example, the physical barrier 114 may not sufficiently attenuate a low-frequency component of the audio output 150, so the audio device 130 may reduce the audio output 150 in the corresponding frequency band. As another example, the room 112 may have a fan noise that masks a given frequency band in the detected audio signal 152, so the audio device 130 may not need to reduce the audio output 150 in that given frequency band (but may reduce the audio output 150 in other bands). The method 200 may then return to 202 for continuous modification of the audio output.

The method steps 204-208 may be performed contemporaneously with the method steps 202 and 210. For example, as the audio device 130 (see FIG. 1) is generating the audio output 150 (step 202), it is receiving the information related to the detected audio signal 152 (step 206), determining the audio transfer function (step 208), and dynamically modifying the audio output 150 (step 210). In this manner, the audio device 130 is reactive to changing circumstances.

Alternatively, one or more of the method steps 204-208 may be performed in a setup phase, and the steps 202 and 210 may be performed in an operational phase, as further described with reference to FIG. 3.

Figure 3:
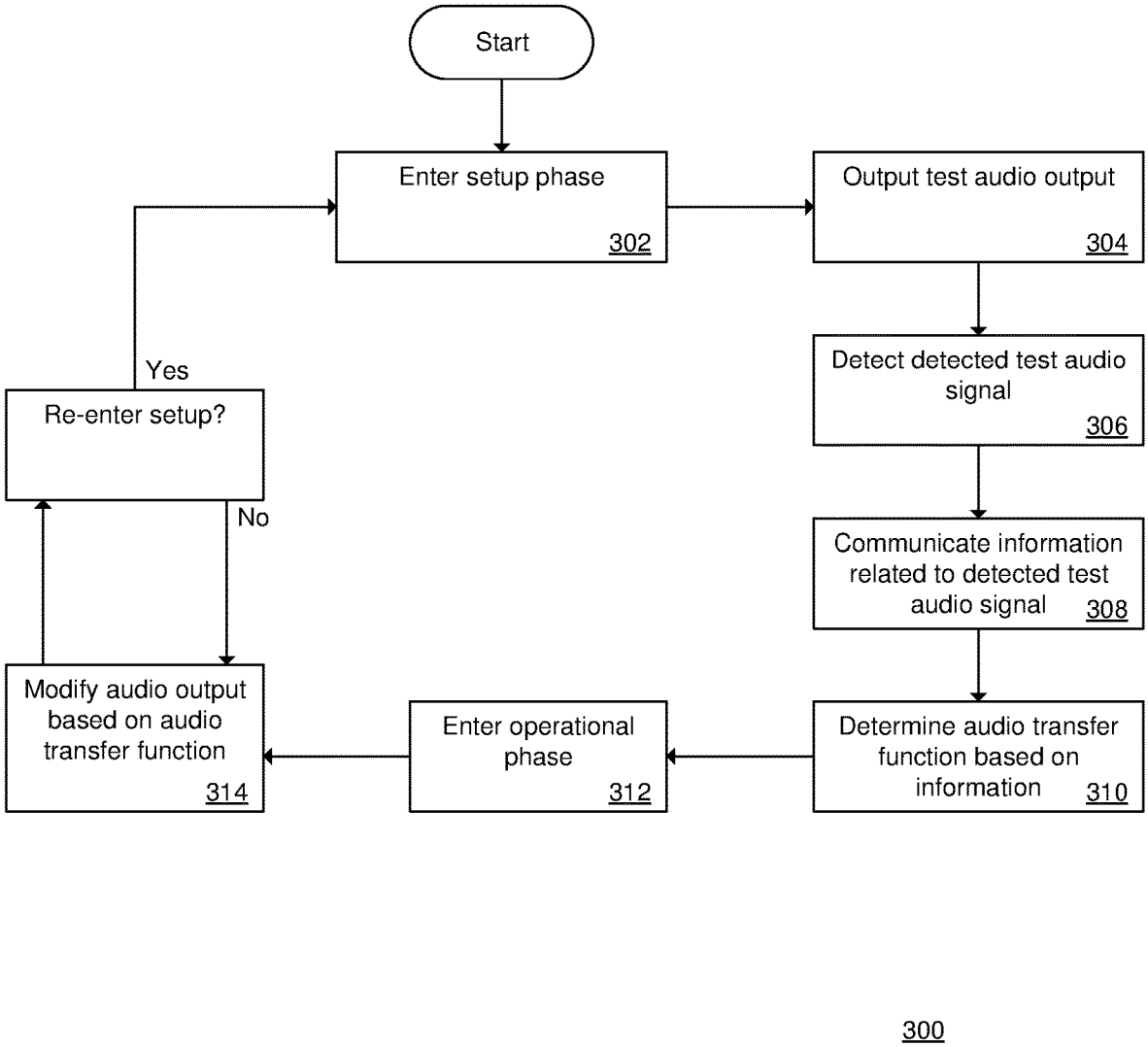
FIG. 3 is a flowchart of a method 300 of configuring and operating an audio device.

FIG. 3 is a flowchart of a method 300 of configuring and operating an audio device. Instead of two audio devices (e.g., the audio devices 130 and 140 of FIG. 1) operating concurrently, the audio devices may operate in two phases: a setup phase and an operational phase.

At 302, the audio devices enter the setup phase. The audio devices may be referred to as a primary audio device (generally corresponding to the audio device 130), and a secondary audio device (generally corresponding to the audio device 140). The secondary audio device may be implemented with a mobile device (e.g., a mobile telephone) that executes a setup application. The primary audio device is located in a first location (e.g., in the room 110), and the secondary audio device is located in a second location (e.g., in the room 112).

At 304, the primary audio device outputs a test audio output. (The test audio output is analogous to the audio output 150 of FIG. 1.) In general, the test audio output covers a range of levels and frequencies.

At 306, the secondary audio device detects a detected test audio signal corresponding to the test audio output. (The detected test audio signal is analogous to the detected audio signal 152 of FIG. 1.)

At 308, the secondary audio device communicates information related to the detected test audio signal to the primary audio device.

At 310, the primary audio device determines the audio transfer function based on the information. Since the test audio output covers a range of levels and frequencies, the method determines the attenuation of the test audio output in the second location (e.g., due to the physical barrier 114, etc.). At this point, the setup phase ends.

At 312, the primary audio device enters the operational phase.

At 314, the primary audio device modifies an audio output based on the audio transfer function, and outputs the audio output having been modified. For example, if the level of a particular frequency band of the detected audio is above a threshold, the primary audio device reduces the audio output in that particular frequency band.

The devices may re-enter the setup phase at a later time, as desired. For example, if the door 116 (see FIG. 1) was closed during the initial setup, and then the door 116 is opened, a user may desire the primary audio device to re-determine the audio transfer function. As another example, if the user desires to re-configure the primary audio device to adapt to detected audio signals in a third location, the user may place the secondary audio device in the third location, and re-enter the setup phase to determine the audio transfer function related to the third location.

Figure 4:
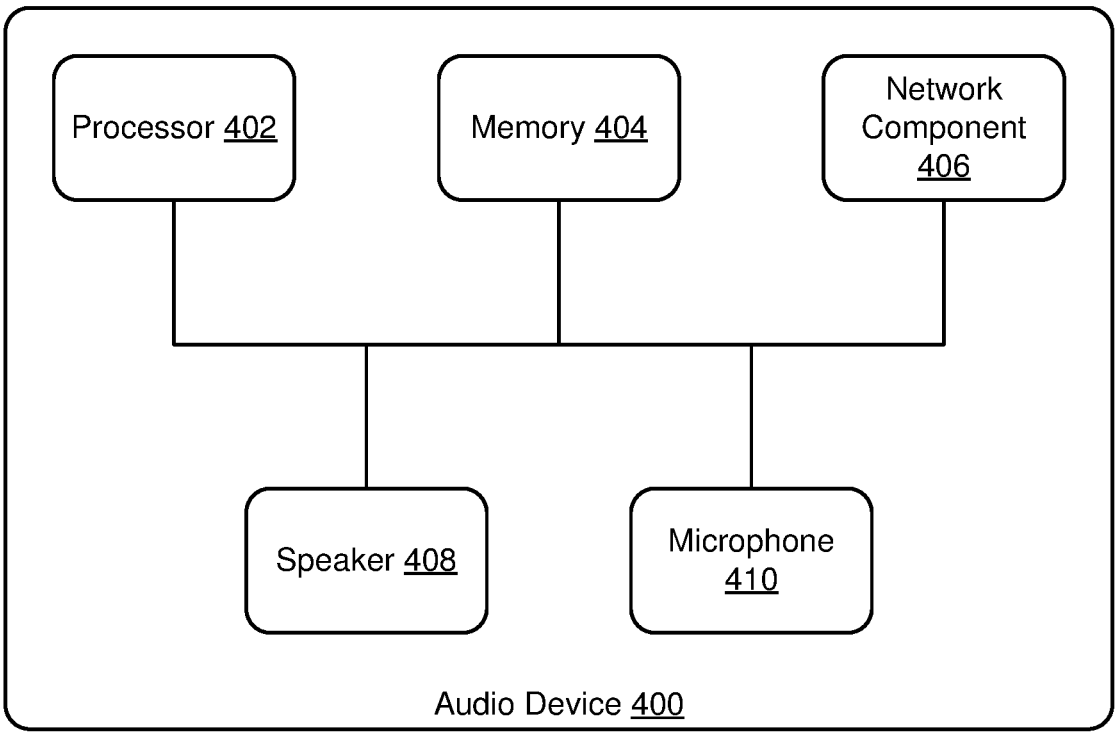
FIG. 4 is a block diagram of an audio device 400.

FIG. 4 is a block diagram of an audio device 400. The audio device 400 may correspond to the audio device 130 or the audio device 140 (see FIG. 1). The audio device 400 may implement one or more steps of the method 200 (see FIG. 2) or the method 300 (see FIG. 3). The audio device 400 includes a processor 402, a memory 404, a network component 406, a speaker 408, and a microphone 410. The audio device 400 may include other components, which for brevity are not detailed. The hardware of the audio device 400 may be implemented by an existing device such as the Echo™ device from Amazon or the HomePod™ device from Apple, that has been modified with additional functionality as described throughout the present document.

The processor 402 generally controls the operation of the audio device 400. The processor 402 may implement one or more steps of the method 200 (see FIG. 2) or the method 300 (see FIG. 3), for example by executing one or more computer programs.

The memory 404 generally provides storage for the audio device 400. The memory 404 may store the programs executed by the processor 402, various configuration settings, etc.

The network component 406 generally enables electronic communication between the audio device 400 and other devices (not shown). For example, when the audio device 400 is used to implement the audio devices 130 and 140 (see FIG. 1), the network component 406 enables electronic communication between the audio devices 130 and 140. As another example, the network component 406 may connect the audio device 400 to a router device (not shown), a server device (not shown), or another device as an intermediate device between the audio device 400 and another device. The network component 406 may implement a wireless protocol, such as the IEEE 802.11 protocol (e.g., wireless local area networking), the IEEE 802.15.1 protocol (e.g., the Bluetooth™ standard), etc. In general, the network component 406 enables communication of the information related to the detected audio signal (see 206 in FIG. 2).

The speaker 408 generally outputs an audio output (e.g., corresponding to the audio output 150 of FIG. 1). The speaker 408 may be one of a number of speakers that are components of the audio device 400.

The microphone 410 generally detects an audio signal. As discussed above, when the audio device 400 implements the audio device 140 (see FIG. 1), the microphone 410 detects the audio signal 152 that propagates into the room 112 from the audio device 130. The microphone 410 may also detect other audio inputs in the vicinity of the audio device 400, such as fan noise, ambient noise, conversations, etc.

As an alternative to having both the speaker 408 and the microphone 410, the audio device 400 may have only one of the two. As an example, the audio device 400 may omit the microphone 410. As another example, the audio device 400 may omit the speaker 408.

Figure 5:
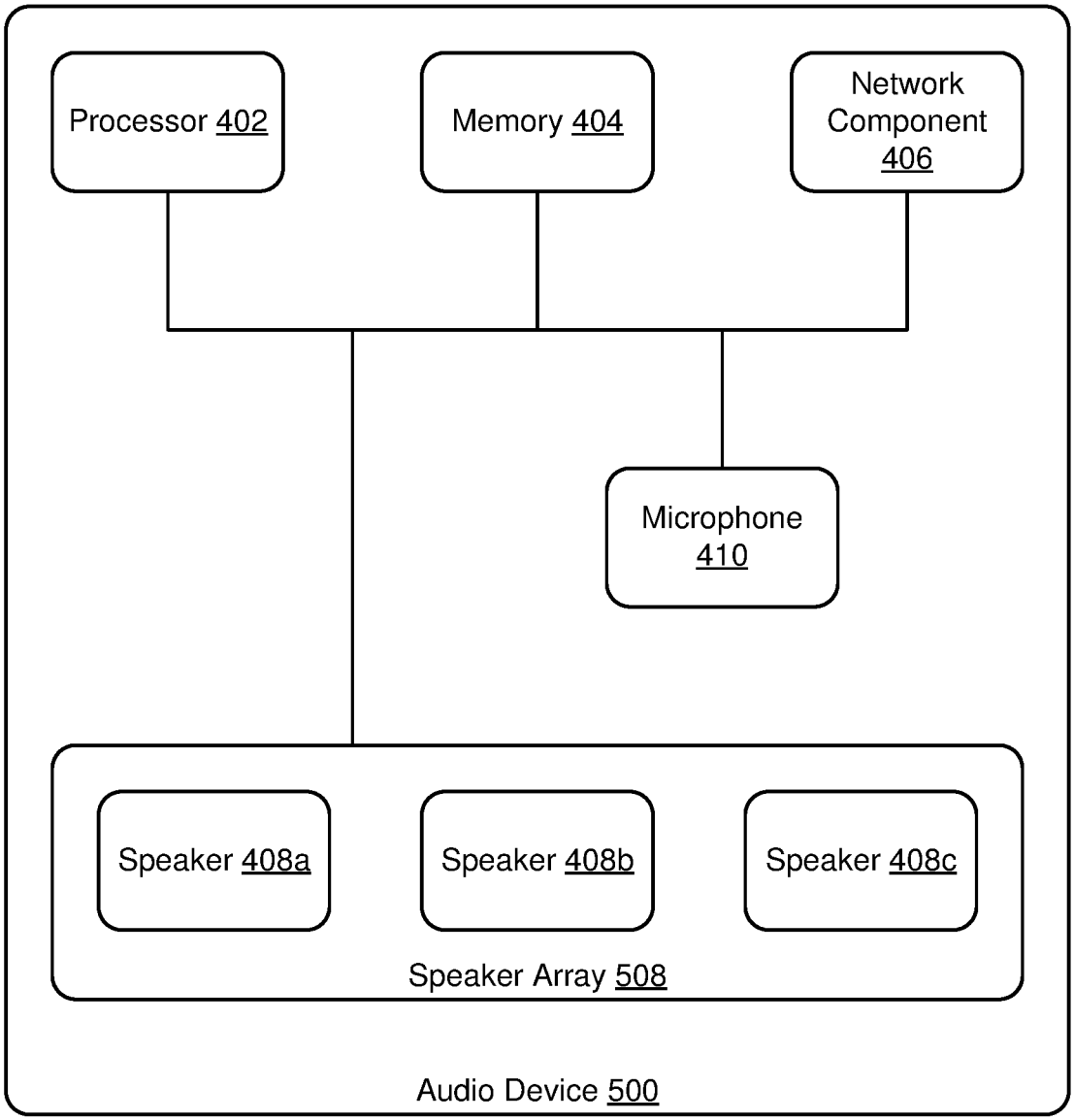
FIG. 5 is a block diagram of an audio device 500.

FIG. 5 is a block diagram of an audio device 500. As compared to the audio device 400 (see FIG. 4), the audio device 500 includes a speaker array 508. The speaker array 508 includes a plurality of speakers (408*a*, 408*b* and 408*c* shown). The audio device 500 also includes a processor 402, a memory 404, a network component 406, and a microphone 410 as discussed above regarding the audio device 400 (see FIG. 4). (The microphone 410 may be omitted from the audio device 500, as discussed above regarding the audio device 400.)

The speaker array 508 may apply loudspeaker directivity to its audio output in order to reduce the detected audio in the adjacent room. In general, loudspeaker directivity refers to adjusting the size, shape or direction of the audio output. Loudspeaker directivity may be implemented by using only a subset of the speakers in the speaker array 508, by selecting only a subset of the drivers for the speaker array 508, or by beamforming using multiple drivers. In general, beamforming includes adjusting the output from each speaker (such as the delay, the volume, and the phase) to control the size, shape or direction of the aggregate audio output. For example, the level of the audio output may be increased in one direction or location, and decreased in another direction or location.

The audio device 500 may control the loudspeaker directivity when it modifies its audio output (see 210 in FIG. 2). For example, if the information related to the detected audio signal from the other room (see 206 in FIG. 2) exceeds a threshold in a particular frequency band, the audio device 500 may modify the loudspeaker directivity to adjust the direction or location of the audio output, and monitor the results. If the subsequent information related to the detected audio signal indicates that the detected audio signal no longer exceeds the threshold, then the directivity adjustment has been successful; otherwise the audio device 500 provides a different directivity adjustment to the radiation pattern or location of the audio output.

The following sections describe additional features of the audio devices discussed herein.

Frequency Bands

In general, a transfer function refers to a function that maps various input values to various output values. As used herein, the audio transfer function refers to the amplitude of the output as a function of the frequency of the input. The audio device may determine the audio transfer function on a per-band basis, with each particular band having a different attenuation amount applied to its amplitude.

The audio devices described herein (e.g., the audio device 400 of FIG. 4) may use different thresholds for different frequency bands of the detected audio signal. If the information related to the detected audio signal exceeds a threshold in a particular frequency band, the audio device determines an audio transfer function that, when applied to the audio output, reduces the amplitude of the audio output in that particular frequency band. For example, a low frequency band may have a lower threshold than a middle frequency band or a high frequency band. The thresholds may be defined according to human psychoacoustics. For example, if human hearing is more sensitive in a first band than in a second band, the threshold for the first band may be set lower than the threshold for the second band.

The thresholds may be set according to a psychoacoustic model of human hearing. An example of using a psychoacoustic model for the thresholds is described by B. C. J. Moore, B. Glasberg, T. Baer, "A Model for the Prediction of Thresholds, Loudness, and Partial Loudness", in Journal of the Audio Engineering Society, Vol. 45, No. 4, April 1997, pp. 224-240. In this model, a set of critical band filter responses are spaced uniformly along the Equivalent Rectangular Bandwidth (ERB) scale, where each filter shape is described by a rounded exponential function and the bands are distributed using a spacing of 1 ERB. The number of filter responses in the set may be 40, or 20, or another suitable value. Another example of using a psychoacoustic model for the thresholds is described in U.S. Pat. No. 8,019,095.

The audio device may apply a gradual reduction in dB to the audio output when the threshold is exceeded in a particular frequency band. For example, when the detected audio signal exceeds the threshold by 5 dB in a particular band, the audio device may gradually (e.g., over a span of 5 seconds) apply a 5 dB attenuation in that particular band to the audio output, using the audio transfer function.

Optionally, the band specific thresholds may be determined based on both an ambient noise level that has been determined for that specific band and a predetermined threshold for that band, e.g. based on a psychoacoustic model. For example, each of the band specific thresholds may be the maximum of a predetermined threshold level for that band based on a psychoacoustic model (which is independent of actual audio output and actual noise level) and the ambient noise level in that frequency band (which is based on the actual noise in the second location). Therefore, the band specific thresholds based on the psychoacoustic model will be used, except where the ambient noise level exceeds said threshold level.

FIGS. 6A-6E are tables that illustrate an example of the thresholds and frequency bands for the audio output and the detected audio signal. FIG. 6A shows the levels of the audio output in the first location, which is 100 dB in each of three bands. (Only three bands are shown for ease of illustration, but as discussed above, the audio device may implement more than three bands, e.g. 20-40 bands.) FIG. 6B shows the levels of the detected audio signal in the second location, which is 75 dB in the first band, 60 dB in the second band, and 50 dB in the third band. In comparing FIG. 6A and FIG. 6B, note that the transmission characteristic between the two locations is more transmissive to the first band than to the second band, and more transmissive to the second band than to the third band.

FIG. 6C shows the thresholds for the three bands, which are 70, 60 and 55 dB. In comparing FIG. 6B and FIG. 6C, note that the threshold is exceeded in the first band by 5 dB, so the audio device determines an audio transfer function that reduces the audio output in that band (e.g., gradually by 5 dB).

FIG. 6D shows the levels of the audio output in the first location as a result of applying the audio transfer function. In comparing FIG. 6A and FIG. 6D, note that the audio output in the first band is now 95 dB (previously 100 dB), and the other bands are unchanged. FIG. 6E shows the levels of the detected audio signal in the second location; note that all bands are now at or below the thresholds of FIG. 6C.

In effect, the audio device operates as a multi-band compressor/limiter to the audio output, based on comparing the thresholds to the detected audio signal.

Audio Processing

The audio devices described herein (e.g., the audio device 400 of FIG. 4) may implement one or more audio processing techniques to modify the audio output (see 210 in FIG. 2). For example, the audio device may implement the Dolby® Audio™ solution, the Dolby® Digital Plus solution, the Dolby® Multistream Decoder MS12 solution, or other suitable audio processing techniques. The audio device may modify the audio output using various features such as a dialogue enhancer feature, a volume leveler feature, an equalizer feature, an audio regulator feature, etc. For example, if the audio device determines that the audio output includes dialogue, the audio device may activate the dialogue enhancer feature prior to applying the audio transfer function. As another example, the audio device may apply the volume leveler feature prior to applying the audio transfer function. As another example, the audio device may use the equalizer feature to adjust the level of the audio output in a particular frequency band if the information related to the detected audio signal from the other room exceeds a threshold in that particular frequency band. As another example, the audio device may use the audio regulator feature (traditionally used to keep a speaker within defined limits to avoid distortion, typically of the lower frequencies) to reduce selected frequency bands (e.g., using a multiband compressor) prior to applying the audio transfer function.

Machine Learning

The audio devices described herein (e.g., the audio device 400 of FIG. 4) may collect usage statistics and perform machine learning to determine usage patterns, and may use the determined usage patterns when adjusting the audio output. The usage patterns may coalesce to daily patterns, weekday versus weekend patterns, etc. For example, if during most days there is a low amount of ambient noise in the adjacent room between midnight and 6 am, this may indicate that someone is sleeping in the adjacent room; as a result of this usage pattern, the audio device may reduce its audio output during that time period even in the absence of the detected audio signal exceeding a threshold. As another example, the ambient noise in the adjacent room may shift to a later period on the weekends (corresponding to the person in the adjacent room staying up later and sleeping later); as a result of this usage pattern, the audio device may reduce its audio output at a later time as compared to during the weekdays. As another example, if the user moves the audio device within the first location (or from the first location into a different location), the usage statistics will begin to reflect the new position (with respect to the second location due to the changing transmission, directivity, etc.), and the machine learning eventually results in the audio output being adjusted according to the new position.

Once the audio device has identified a usage pattern, the audio device may ask the user to confirm the usage pattern. For example, when the audio device identifies a quiet period in the adjacent room on weekdays between midnight and 6 am, the audio device asks the user to confirm this usage pattern. The audio device may also reset its usage statistics, e.g. according to a user selection. For example, in the arrangement of FIG. 1, if the audio device 140 is moved to a third room (not shown), the user may select that the audio device 130 resets its usage statistics to conform to the new location of the audio device 140.

The audio devices described herein (e.g., the audio device 500 of FIG. 5) may collect usage statistics and perform machine learning when performing loudspeaker directivity control on the audio output. This allows the audio device to build a loudspeaker directivity map at the location of the other audio device, and to select a loudspeaker directivity configuration that has worked in the past to reduce the detected audio signal in the second location. For example, in the arrangement of FIG. 1, the audio device 130 initially performs no loudspeaker directivity control, and the audio output 150 is directed at 0 degrees. Based on the detected audio signal 152, the audio device 130 adjusts its radiation pattern; the machine learning indicates that the maximum level of the detected audio signal 152 is when the audio output 150 is directed at 0 degrees, and falls below a threshold when the audio output 150 is directed at +30 degrees (e.g., 30 degrees rightward when viewed from above). When the audio device 130 is performing loudspeaker directivity control at a future time, it can use +30 degrees as the selected main direction of acoustic radiation, and then monitor that the level of the detected audio signal 152 falls below the threshold.

Preset Features

Instead of continuously detecting the detected audio signal and modifying the audio output (e.g., FIG. 2), or performing a setup function (e.g., FIG. 3), the audio devices described herein (e.g., the audio device 400 of FIG. 4) may store a number of general audio transfer functions that may be selected by a user. Each of the general audio transfer functions may correspond to one of a variety of listening environment configurations, where the values in each audio transfer function may be calculated empirically for the variety of listening environment configurations. For example, the listening environment configurations may include a small apartment (e.g., 1 bedroom and 2 other rooms), a large apartment (e.g., 3 bedrooms and 3 other rooms), a town house with 2 floors, a town house with 3 floors, a small house (e.g., 2 bedrooms and 4 other rooms), a large house (e.g., 4 bedrooms and 6 other rooms), a large house with 2 floors, etc. When the user selects the relevant listening environment configuration, the user may also indicate the room location of the audio device, which may affect the audio transfer function. For example, when the audio device is placed in a bedroom, the audio transfer function may attenuate the audio output less than when the audio device is placed in a living room.

Client-Server Features

As discussed above (e.g., 206 in FIG. 2), the audio device (e.g., the audio device 130 of FIG. 1) determines the audio transfer function. As an alternative, a server device may receive the information related to the detected audio signal from the second location (e.g., transmitted by the audio device 140), determine the audio transfer function, and transmit the audio transfer function to the first location (e.g., to the audio device 130). The server device may be a computer that is located in the house with the audio device, or the server device may be located remotely (e.g., a cloud service accessed via a computer network).

The server may also collect the usage statistics from the audio devices, may perform machine learning on the usage statistics, and may provide the results to the audio devices. For example, the audio device 140 in the second room may send its usage statistics to the server; the server may perform machine learning and determine that there is usually no ambient noise in the second room between midnight and 6 am; the server sends the results of its analysis to the audio device 130 in the first room; and the audio device 130 modifies the audio output accordingly.

Multi-Device Features

As shown above (e.g., FIG. 1), the acoustic environment 100 is discussed in the context of two rooms and an audio device in each room. These features may be extended to operate in more than two rooms and more than two audio devices: Each audio device may be generating an audio output and detecting the audio signals from the other audio devices. For example, if there are three rooms and three audio devices, the first audio device may generate an audio output and may detect the audio signal from the second and third audio devices; the second audio device may generate an audio output and may detect the audio signal from the first and third audio devices; the third audio device may generate an audio output and may detect the audio signal from the first and second audio devices.

Each audio device may then determine the audio transfer function based on the detected audio signals from each other audio device. Returning to the three device example, if (from the perspective of the first audio device) the detected audio signal from the second audio device exceeds a threshold in a first frequency band, and the detected audio signal from the third audio device exceeds a threshold in a second frequency band, the first audio device may determine the audio transfer function as a combined function that attenuates the audio output in the first frequency band and the second frequency band.

Each audio device may determine the nearby presence of other audio devices according to the network protocol implemented. For example, for an IEEE 802.11 network protocol, the various audio devices may discover each other via wireless ad hoc networking, or may each connect to a wireless access point that provides the discovery information. As another example, for an IEEE 802.15.1 network protocol, the various audio devices may discover each other using a pairing process.

Inter-Home Features

As shown above (e.g., FIG. 1), the acoustic environment 100 is discussed in the context of a single home or apartment. The functionality of the audio devices may be extended such that an audio device in one home (or apartment) adjusts its audio output in response to information from an audio device in another home (or apartment). This adjustment may be performed without knowledge by the owners of the various audio devices. For example, imagine a college dormitory with 20 rooms on each floor, and an audio device in each room. Each audio device adjusts its output in response to the detected audio signal from each other audio device, reducing the amount of sound among the various dormitory rooms.

Implementation Details

An embodiment may be implemented in hardware, executable modules stored on a computer readable medium, or a combination of both (e.g., programmable logic arrays). Unless otherwise specified, the steps executed by embodiments need not inherently be related to any particular computer or other apparatus, although they may be in certain embodiments. In particular, various general-purpose machines may be used with programs written in accordance with the teachings herein, or it may be more convenient to construct more specialized apparatus (e.g., integrated circuits) to perform the required method steps. Thus, embodiments may be implemented in one or more computer programs executing on one or more programmable computer systems each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a non-transitory computer-readable storage medium, configured with a computer program, where the storage medium so configured causes a computer system to operate in a specific and predefined manner to perform the functions described herein. (Software per se and intangible or transitory signals are excluded to the extent that they are unpatentable subject matter.)

The above description illustrates various embodiments of the present invention along with examples of how aspects of the present invention may be implemented. The above examples and embodiments should not be deemed to be the only embodiments, and are presented to illustrate the flexibility and advantages of the present invention as defined by the following claims. Based on the above disclosure and the following claims, other arrangements, embodiments, implementations and equivalents will be evident to those skilled in the art and may be employed without departing from the spirit and scope of the invention as defined by the claims.

Various aspects of the present invention may be appreciated from the following enumerated example embodiments (EEEs):

1. A method of reducing audibility of sound generated by an audio device, the method comprising:

generating, by the audio device in a first location, an audio output;

detecting, in a second location that differs from the first location, a detected audio signal corresponding to the audio output;

communicating information related to the detected audio signal from the second location to the audio device;

determining, by the audio device, an audio transfer function of the detected audio signal based on the information; and modifying, by the audio device, the audio output based on the audio transfer function.

2. The method of EEE 1, wherein determining the audio transfer function includes comparing the information related to the detected audio signal, information related to the audio output, and at least one threshold value.

2A. The method of EEE 2, wherein the audio device determines the audio transfer function for attenuating one or more frequency bands of the audio output, the method comprising:

dividing the audio output and the detected audio into at least three spectral bands, e.g. 20-40 spectral bands;

performing a per spectral band comparison of the detected audio with a band specific threshold level; and attenuating only those spectral bands of the audio output for which the detected audio exceeds the band specific threshold level.

3. The method of EEE 1, wherein a physical barrier separates the first location and the second location.

4. The method of EEE 3, wherein the audio device determines the audio transfer function of the detected audio signal according to the audio output as modified by the physical barrier.

5. The method of EEE 1, wherein the audio device is a first audio device, wherein a second audio device in the second location detects the detected audio signal, and wherein the second audio device communicates the information related to the detected audio signal to the first audio device.

6. The method of EEE 5, wherein the first audio device modifies the audio output contemporaneously with the second audio device detecting the detected audio signal.

7. The method of EEE 5, wherein the second audio device detects the detected audio signal during a setup phase, wherein the first audio device determines the audio transfer function during the setup phase, and wherein the first audio device modifies the audio output during an operational phase that follows the setup phase.

8. The method of EEE 1, wherein the audio output includes a plurality of frequency bands, wherein modifying the audio output includes modifying the audio output in one or more of the plurality of frequency bands based on the audio transfer function.

9. The method of EEE 8, wherein the plurality of frequency bands are defined according to a physiological response of human hearing.

10. The method of EEE 8, wherein modifying the audio output includes modifying the audio output in the one or more of the plurality of frequency bands by one or more different amounts based on the audio transfer function.

11. The method of EEE 1, wherein the audio transfer function is based on a measured transmission characteristic between the first location and the second location, and on an ambient noise level of the second location.

12. The method of EEE 1, wherein the audio transfer function is based on a measured transmission characteristic between the first location and the second location, and on a physiological response of human hearing.

13. The method of EEE 1, wherein the audio device includes a plurality of speakers, and wherein modifying the audio output includes:

controlling loudspeaker directivity, using the plurality of speakers, to adjust a locational response of the audio output such that a first level of the audio output in the first location is maintained, and a second level of the detected audio signal in the second location is reduced.

14. The method of EEE 1, wherein the audio output is modified using at least one of loudness leveling and loudness domain processing.

15. The method of EEE 1, further comprising:

continuously detecting an ambient noise level in the second location; and determining, using machine learning, at least one pattern in the ambient noise level having been detected, wherein the audio output is modified based on the audio transfer function and the at least one pattern.

16. The method of EEE 1, further comprising:

generating, by a third audio device in a third location, a second audio output, wherein the detected audio signal detected in the second location corresponds to the audio output and the second audio output, wherein the information is related to the detected audio signal and the second detected audio signal, and wherein the information is communicated to the audio device and the third audio device;

determining, by the third audio device, a second audio transfer function of the detected audio signal based on the information; and modifying, by the third audio device, the second audio output based on the second audio transfer function.

17. An apparatus including an audio device for reducing audibility of sound generated by the audio device, the apparatus comprising:

a processor;

a memory;

a speaker; and a network component, wherein the processor is configured to control the audio device to execute processing comprising:

generating, by the speaker in a first location, an audio output;

receiving, by the network component from a second location that differs from the first location, information related to a detected audio signal corresponding to the audio output detected in the second location;

determining, by the processor, an audio transfer function of the detected audio signal based on the information; and modifying, by the processor, the audio output based on the audio transfer function.

18. A system for reducing audibility of sound generated by an audio device, the system comprising:

a first audio device, the first audio device comprising a processor, a memory, a speaker, and a network component; and a second audio device, the second audio device comprising a processor, a memory, a microphone, and a network component, wherein the processor of the first audio device and the processor of the second audio device are configured to control the first audio device and the second audio device to execute processing comprising:

generating, by the speaker of the first audio device in a first location, an audio output;

detecting, by the microphone of the second audio device in a second location that differs from the first location, a detected audio signal corresponding to the audio output;

communicating, via the network component of the second audio device, information related to the detected audio signal from the second location to the network component of the first audio device;

determining, by the processor of the first audio device, an audio transfer function of the detected audio signal based on the information; and modifying, by the processor of the first audio device, the audio output based on the audio transfer function.

19. The system of EEE 18, wherein the first audio device further comprises a microphone, wherein the second audio device further comprises a speaker, and wherein the second audio device adjusts an audio output of the second audio device in response to information related to a detected audio signal of the first audio device.

20. A non-transitory computer readable medium storing a computer program for controlling an audio device to reduce audibility of sound generated by the audio device, wherein the audio device includes a processor, a memory, a speaker, and a network component, wherein the computer program when executed by the processor controls the audio device to perform processing comprising:

generating, by the speaker in a first location, an audio output;

receiving, by the network component from a second location that differs from the first location, information related to a detected audio signal corresponding to the audio output detected in the second location;

determining, by the processor, an audio transfer function of the detected audio signal based on the information; and modifying, by the processor, the audio output based on the audio transfer function.

REFERENCES

1: EP application EP0414524A2 published Feb. 27, 1991.

2: U.S. Application Pub. No. 2012/0121097.

3: ES application ES2087020A2 published Jul. 1, 1996.
4: ES application ES2087020A2.
5: U.S. Application Pub. No. 2012/0195447.
6: U.S. Application Pub. No. 2009/0129604.
7: U.S. Application Pub. No. 2016/0211817.
8: U.S. Pat. No. 8,019,095.

The invention claimed is:

1. A method of reducing audibility of sound generated by an audio device, the method comprising:

generating, by the audio device in a first location, an audio output;

detecting, in a second location that differs from the first location, a detected audio signal corresponding to the audio output in a plurality of frequency bands;

communicating information related to the detected audio signal in the plurality of frequency bands to the audio device;

determining, by the audio device, an audio transfer function for attenuating one or more frequency bands of the audio output based on the information and a plurality of thresholds, wherein for a given frequency band, the audio transfer function attenuates the given frequency band of the audio output when the given frequency band of the detected audio signal exceeds a corresponding threshold; and modifying, by the audio device, the audio output by applying the audio transfer function.

2. The method of claim 1, wherein determining the audio transfer function includes comparing the information related to the detected audio signal, information related to the audio output, and at least one threshold value.

3. The method of claim 2, comprising:

dividing the audio output and the detected audio signal into at least three spectral bands;

performing a per spectral band comparison of the detected audio signal with a band specific threshold level; and attenuating only those spectral bonds of the audio output for which the detected audio exceeds the band specific threshold level.

4. The method of claim 1, wherein a physical barrier separates the first location and the second location.

5. The method of claim 4, wherein the audio device determines the audio transfer function of the detected audio signal according to the audio output as modified by the physical barrier.

6. The method of claim 1, wherein the audio device is a first audio device, wherein a second audio device in the second location detects the detected audio signal, and wherein the second audio device communicates the information related to the detected audio signal to the first audio device.

7. The method of claim 6, wherein the first audio device modifies the audio output contemporaneously with the second audio device detecting the detected audio signal.

8. The method of claim 6, wherein the second audio device detects the detected audio signal during a setup phase, wherein the first audio device determines the audio transfer function during the setup phase, and wherein the first audio device modifies the audio output during an operational phase that follows the setup phase, wherein during the setup phase, the first audio device outputs a rest audio output that covers a range of frequencies, and the second audio device receives a detected test audio signal that corresponds to the test audio output, and wherein the audio transfer function attenuates a particular frequency band in the test audio output when a level of the particular frequency band in the detected test audio signal exceeds a corresponding threshold for the particular frequency band.

9. The method of claim 1, wherein the plurality of thresholds are defined according to a physiological response of human hearing.

10. The method of claim 9, wherein a first threshold for a first frequency band differs from a second threshold for a second frequency band according to the physiological response of human hearing.

11. The method of claim 1, wherein modifying the audio output includes attenuating the one or more frequency bands of the audio output by one or more different amounts.

12. The method of claim 1, wherein the audio output is modified using at least one of loudness leveling and loudness domain processing.

13. The method of claim 1, further comprising:

continuously detecting an ambient noise level in the second location using a microphone; and determining, using machine learning, at least one pattern in the ambient noise level having been detected, wherein the audio output is modified based on the audio transfer function and the at least one pattern.

14. The method of claim 1, wherein the audio device includes a plurality of speakers, and wherein modifying the audio output includes:

controlling loudspeaker directivity, using the plurality of speakers, to adjust a locational response of the audio output such that a level of the detected audio signal in the second location Is reduced.

15. The method of claim 1, wherein the audio transfer function Is determined based on a measured transmission characteristic between the first location and the second location.

16. The method of claim 15, wherein the measured transmission characteristic takes into account a level of ambient noise of the second location.

17. The method of claim 16, wherein the ambient noise is determined by comparing the information related to the detected audio signal and the audio output.

18. The method of claim 16, further comprising determining whether the ambient noise masks one or more frequency bands in the detected audio signal, wherein in response to determining that the ambient noise masks one or more frequency bands in the detected audio signal, the audio transfer function does not attenuate frequency bands of the audio output corresponding to said one or more masking frequency bands.

19. An apparatus comprising:

an audio device;

a processor;

a memory;

a speaker; and a network component, wherein the processor is configured to control the audio device to execute processing comprising:

generating, by the speaker in a first location, an audio output;

receiving, by the network component, information related to a detected audio signal in a plurality of frequency bands corresponding to the audio output in the plurality of frequency bands detected in a second location that differs from the first location;

determining, by the processor, an audio transfer function for attenuating one or more frequency bands of the audio output based on the information and a plurality of thresholds, wherein for a given frequency band, the audio transfer function attenuates the given frequency band of the audio output when the given frequency bend of the detected audio signal exceeds a corresponding threshold; and modifying, by the processor, the audio output by applying the audio transfer function.

20. A system comprising:

a first audio device, the first audio device comprising a processor, a memory, a speaker, and a network component; and a second audio device, the second audio device comprising a processor, a memory, a microphone, and a network component, wherein the processor of the first audio device and the processor of the second audio device are configured to control the first audio device and the second audio device to execute processing comprising:

generating, by the speaker of the first audio device in a first location, an audio output;

detecting, by the microphone of the second audio device in a second location that differs from the first location, a detected audio signal corresponding to the audio output in a plurality of frequency bands;

communicating, via the network component of the second audio device, information related to the detected audio signal in the plurality of frequency bands from the second location to the network component of the first audio device;

determining, by the processor of the first audio device, an audio transfer function for attenuating one or more frequency bands of the audio output based on the information and a plurality of thresholds, wherein for a given frequency bend, the audio transfer function attenuates the given frequency band of the audio output when the given frequency band of the detected audio signal exceeds a corresponding threshold; and modifying, by the processor of the first audio device, the audio output by applying the audio transfer function.

21. The system of claim 20, wherein the first audio device further comprises a microphone, wherein the second audio device further comprises a speaker, and wherein the second audio device adjusts an audio output of the second audio device in response to information related to a detected audio signal of the first audio device.

22. A non-transitory computer readable medium storing a computer program for controlling an audio device to reduce audibility of sound generated by the audio device, wherein the audio device includes a processor, a memory, a speaker, and a network component, wherein the computer program when executed by the processor controls the audio device to perform processing comprising:

generating, by the speaker in a first location, an audio output;

receiving, by the network component from a second location that differs from the first location, information related to a detected audio signal in a plurality of frequency bands corresponding to the audio output in the plurality of frequency bands detected in the second location;

determining, by the processor, an audio transfer function for attenuating one or more frequency bands of the audio output based on the information and a plurality of thresholds, wherein for a given frequency band, the audio transfer function attenuates the given frequency band of the audio output when the given frequency band of the detected audio signal exceeds a corresponding threshold; and modifying, by the processor, the audio output by applying the audio transfer function.

* * * * *